US008671677B2

(12) United States Patent
Berchowitz

(10) Patent No.: US 8,671,677 B2
(45) Date of Patent: Mar. 18, 2014

(54) GAMMA TYPE FREE-PISTON STIRLING MACHINE CONFIGURATION

(75) Inventor: David M. Berchowitz, Athens, OH (US)

(73) Assignee: Global Cooling, Inc., Athens, OH (US)

( * ) Notice: Subject to any disclaimer, the term of this patent is extended or adjusted under 35 U.S.C. 154(b) by 633 days.

(21) Appl. No.: 12/828,387

(22) Filed: Jul. 1, 2010

(65) Prior Publication Data

US 2011/0005220 A1 Jan. 13, 2011

Related U.S. Application Data

(60) Provisional application No. 61/223,449, filed on Jul. 7, 2009.

(51) Int. Cl.
*F01B 29/10* (2006.01)
*F02G 1/04* (2006.01)

(52) U.S. Cl.
USPC ..... 60/520; 60/516; 60/517; 60/518; 60/523; 60/525; 62/6; 62/238.2; 62/520; 123/46 R

(58) Field of Classification Search
USPC ..... 60/520, 516–518, 523, 525; 62/6, 62/238.2, 520; 123/46 R
See application file for complete search history.

(56) References Cited

U.S. PATENT DOCUMENTS 3,812,682 A * 5/1974 Johnson ..... 62/6
4,199,945 A * 4/1980 Finkelstein ..... 60/520
4,888,951 A * 12/1989 Beale ..... 60/520
4,967,558 A * 11/1990 Emigh et al. ..... 60/520
5,146,750 A * 9/1992 Moscrip ..... 60/517
6,311,491 B1 * 11/2001 Conrad ..... 60/520
6,701,721 B1 * 3/2004 Berchowitz ..... 62/6
7,171,811 B1 * 2/2007 Berchowitz et al. ..... 60/525
7,484,366 B2 * 2/2009 Mori ..... 60/517
2007/0193266 A1 * 8/2007 McConaghy ..... 60/520
2010/0095668 A1 * 4/2010 Beale et al. ..... 60/520

OTHER PUBLICATIONS

Webster's New World College Dictonary, Forth Edition, pp. cover 304, 308 Published 1999.*

* cited by examiner

*Primary Examiner* — Kenneth Bomberg
*Assistant Examiner* — Daniel Wagnitz
(74) *Attorney, Agent, or Firm* — Frank H. Foster; Kremblas & Foster

(57) ABSTRACT

An improved free piston Stirling machine having a gamma configuration. The displacer and each piston is reciprocatable within a cylinder having an unobstructed opening at its inner end into a common volume of the workspace. The common volume is defined by the intersection of inward projections of the displacer cylinder and the piston cylinders. The displacer and the pistons each have a range of reciprocation that extends into the common volume. A displacer drive rod is reciprocatable in a drive rod cylinder and both are positioned outside the common volume and on the opposite side of the common volume from the displacer. The displacer is connected to the displacer drive rod by a displacer connecting rod. Importantly, the displacer and pistons have complementary interfacing surface contours formed on their inner ends which substantially reduces the dead volume of this gamma configured machine.

13 Claims, 5 Drawing Sheets

Fig. 5
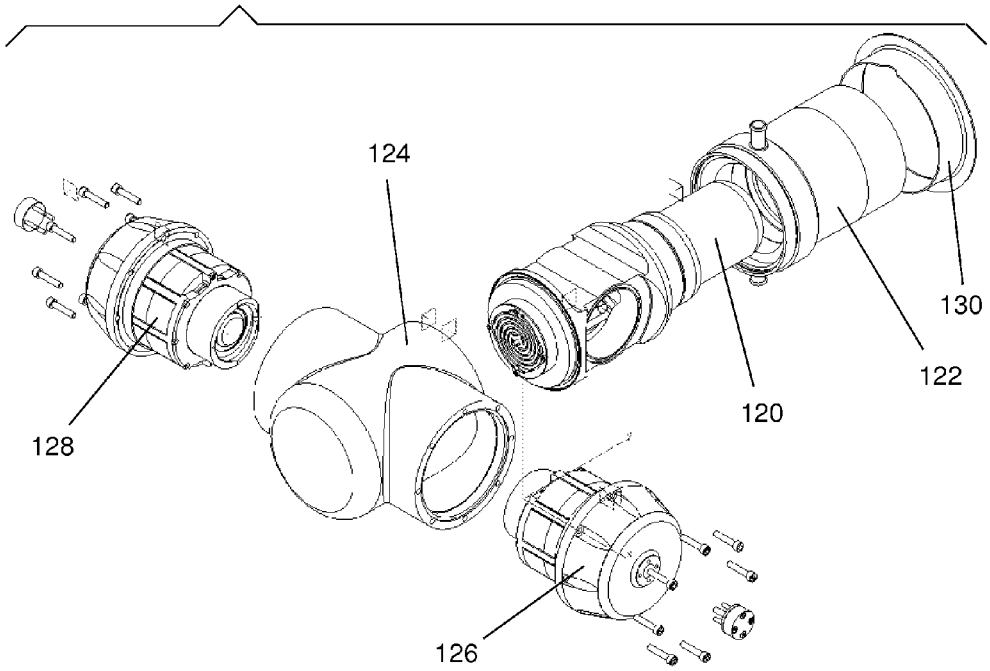
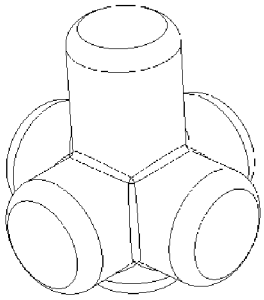
Fig. 6C
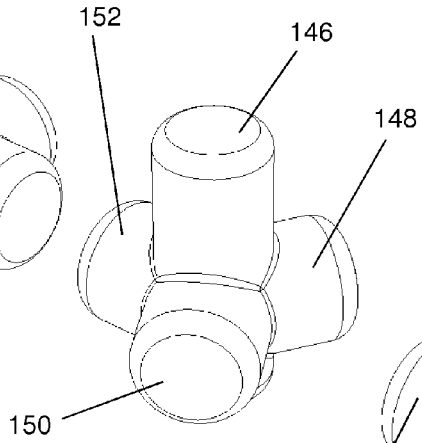
Fig. 6B
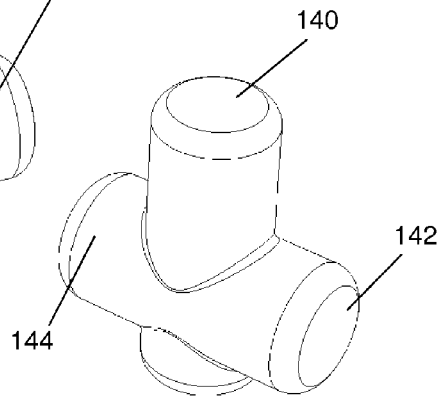
Fig. 6
Fig. 6A

GAMMA TYPE FREE-PISTON STIRLING MACHINE CONFIGURATION

CROSS-REFERENCES TO RELATED APPLICATIONS

This application claims the benefit of U.S. Provisional Application No. 61/223,449 filed Jul. 7, 2009.

The above prior application is hereby incorporated by reference.

STATEMENT REGARDING FEDERALLY-SPONSORED RESEARCH AND DEVELOPMENT (Not Applicable)

REFERENCE TO AN APPENDIX (Not Applicable)

BACKGROUND OF THE INVENTION

This invention is in the field of free piston Stirling machines and more particularly is directed to an improved free piston Stirling machine of the gamma class which minimizes the dead volume normally associated with the gamma configuration.

In a Stirling machine, a working gas is confined in a working space comprised of an expansion space and a compression space. The working gas is alternately expanded and compressed in order to either do work or to pump heat. Each Stirling machine has at least two pistons, one referred to as a displacer and the other referred to as a power piston and often just as a piston. The reciprocating displacer cyclically shuttles a working gas between the compression space and the expansion space which are connected in fluid communication through a heat accepter, a regenerator and a heat rejecter. The shuttling cyclically changes the relative proportion of working gas in each space. Gas that is in the expansion space, and gas that is flowing into the expansion space through a heat exchanger (the accepter) between the regenerator and the expansion space, accepts heat from surrounding surfaces. Gas that is in the compression space, and gas that is flowing into the compression space through a heat exchanger (the rejecter) between the regenerator and the compression space, rejects heat to surrounding surfaces. The gas pressure is essentially the same in the entire work space at any instant of time because the expansion and compression spaces are interconnected through a path having a relatively low flow resistance. However, the pressure of the working gas in the work space as a whole varies cyclically and periodically. When most of the working gas is in the compression space, heat is rejected from the gas. When most of the working gas is in the expansion space, the gas accepts heat. This is true whether the machine is working as a heat pump or as an engine. The only requirement to differentiate between work produced or heat pumped, is the temperature at which the expansion process is carried out. If this expansion process temperature is higher than the temperature of the compression space, then the machine is inclined to produce work so it can function as an engine and if this expansion process temperature is lower than the compression space temperature, then the machine will pump heat from a cold source to a warm heat sink.

Stirling machines can therefore be designed to use the above principles to provide either: (1) an engine having a piston and displacer driven by applying an external source of heat energy to the expansion space and transferring heat away from the compression space and therefore capable of being a prime mover for a mechanical load, or (2) a heat pump having the power piston (and sometimes the displacer) cyclically driven by a prime mover for pumping heat from the expansion space to the compression space and therefore capable of pumping heat energy from a cooler mass to a warmer mass. The heat pump mode permits Stirling machines to be used for cooling an object in thermal connection to its expansion space, including to cryogenic temperatures, or heating an object, such as a home heating heat exchanger, in thermal connection to its compression space. Therefore, the term Stirling "machine" is used to generically include both Stirling engines and Stirling heat pumps, the latter sometimes being referred to a coolers.

Until about 1965, Stirling machines were constructed as kinematically driven machines meaning that the piston and displacer are connected to each other by a mechanical linkage, typically connecting rods and crankshafts. The free piston Stirling machine was then invented by William Beale. In the free piston Stirling machine, the pistons are not connected to a mechanical drive linkage. A free-piston Stirling machine is a thermo-mechanical oscillator and one of its pistons, the displacer, is driven by the working gas pressure variations and differences in spaces or chambers in the machine. The power piston, is either driven by a reciprocating prime mover when the Stirling machine is operated in its heat pumping mode or drives a reciprocating mechanical load when the Stirling machine is operated as an engine.

As well known in the art, there are three principal configurations of Stirling machines. The alpha configuration has at least two pistons in separate cylinders and the expansion space bounded by each piston is connected to a compression space bounded by another piston in another cylinder. These connections are arranged in a series loop connecting the expansion and compression spaces of multiple cylinders. The beta Stirling has a single power piston arranged within the same cylinder as a displacer piston. A gamma Stirling is similar to a beta Stirling but has the power piston mounted in a separate cylinder alongside the displacer piston cylinder.

As is well known, in free-piston Stirling engines and coolers, the displacer and the piston both must be able to freely operate with minimum friction. Since oil or similar lubricants are impractical for use in Stirling machines, non-contact bearings of various types have come to be generally applied. Some researchers use radially stiff flat springs to support the moving parts so as to avoid contact during operation while others have used static gas bearings. All these methods require extremely close tolerances in order to avoid excessive leakage losses and mechanical contact between the moving parts. In the standard displacer-piston beta arrangement, the precision requirements of the displacer and piston compound each other since the displacer rod penetrates the piston. The coaxial alignment of the displacer rod within the piston places additional demands on precision in both displacer and piston and is therefore a strong cost driver.

These problems can be seen in the prior art beta type free piston Stirling machine illustrated in FIG. 1. A hermetically sealed casing 10 has a piston 12 that is reciprocatable in a cylinder 14 and a displacer 16 with a displacer rod 18 that sealingly slides through the piston 12. The end of the displacer rod 18 is connected to a planar spring 20. The work space comprises an expansion space 22 in fluid communication with a compression space 24 through heat exchangers 26 and 28 and a regenerator 30. This illustrates the problem of maintaining the simultaneous alignment of all the interfacing cylindrical surfaces in a manner that has the minimum friction between them but also has sealing engagement between them. All these cylindrical surfaces need to be aligned coaxially and the spaces between them must be small enough to provide a gas seal between them and large enough to minimize friction between them and to make alignment practical.

In the beta arrangement of FIG. 1, each of the reciprocating components is precision aligned in its cylinder. The displacer rod 18 penetrates the piston 12 with a fit requiring concentricity precision along its length with the piston and must therefore be precisely attached to the displacer and planar spring 20 within a limit of concentricity and perpendicularity in order for the displacer and piston not to become jammed during motion. A linear alternator 35 is conventionally attached to the piston 12. Because the piston and displacer move co-axially, there is an out-of-balance reaction force on the casing 10 that is conventionally balanced by a dynamic balancer 32 attached to the casing 10 for minimizing the axial vibrations that result from the axially reciprocating masses.

The well-known gamma configuration overcomes this alignment problem by arranging the displacer and piston in separate cylinders so that their individual requirements for precision do not interfere with each other as in the case of the beta configuration. However, a disadvantage of the gamma arrangement is that it has a higher dead volume than the beta configured machine. Further, in most prior art gamma machines, the placement of the piston and displacer in separate cylinders results in both an oscillating torque and a force on the casing that is more difficult to balance than the single oscillating axial force on the casing in the beta machine. This latter problem has been identified in at least one design published in the open literature where two opposing pistons are used to remove the oscillating torque component on the casing.

A second problem associated with beta free-piston machines is that the dynamic balancing technique that is universally used relegates these machines to operation at a single frequency. Arranging single frequency operation for engines is difficult and requires that the machine be frequency stabilized by, for example, direct electrical grid connection. On coolers, single frequency operation is easily established since the machines are electrically driven. However, even on these machines, there is sometimes a thermodynamic advantage in changing the operating frequency, which is not possible if a dynamic balancer is used. An ideal configuration for a free-piston Stirling machine would have:

a. No more precision than required for good thermodynamic operation.

b. A minimum dead volume.

c. Balancing under all operating conditions including different operating frequencies.

It is therefore an object and feature of the invention to provide a free piston Stirling machine in a gamma configuration that has power pistons with masses and orientations for balancing the vibration forces of the pistons and, most importantly, minimizes the dead (unswept) volume of the work space in order to reduce the size and mass of the machine and improve its efficiency.

BRIEF SUMMARY OF THE INVENTION

The invention is an improved free piston Stirling machine having a gamma configuration. The machine includes a displacer having an inner end and is reciprocatable within a displacer cylinder along a displacer axis. Two or more power pistons are arranged in a balanced configuration for canceling their momentum vectors to minimize vibration. Each piston has an inner end and is reciprocatable within a cylinder having an inner end. Each cylinder has an unobstructed opening at its inner end that opens into a common volume of the workspace. The common volume is defined by the intersection of inward projections of the displacer cylinder and the piston cylinders. The displacer and the pistons each have a range of reciprocation that extends into the common volume. A displacer drive rod functioning like a piston is reciprocatable in a drive rod cylinder. The displacer drive rod and its cylinder are positioned outside the common volume and on the opposite side of the common volume from the displacer. The displacer is connected to the displacer drive rod by a displacer connecting rod. The displacer and pistons have complementary interfacing surface contours formed on their inner ends.

BRIEF DESCRIPTION OF THE SEVERAL VIEWS OF THE DRAWINGS

FIG. 5 is an exploded view in perspective illustrating assembly of the embodiment of the invention illustrated in FIG. 2.

FIG. 6A is a view in perspective of the casing of an embodiment of the invention having two opposed pistons.

FIG. 6B is a view in perspective of the casing of an embodiment of the invention having three pistons.

FIG. 6C is a view in perspective of the casing of an embodiment of the invention having four pistons.

Figure 1:
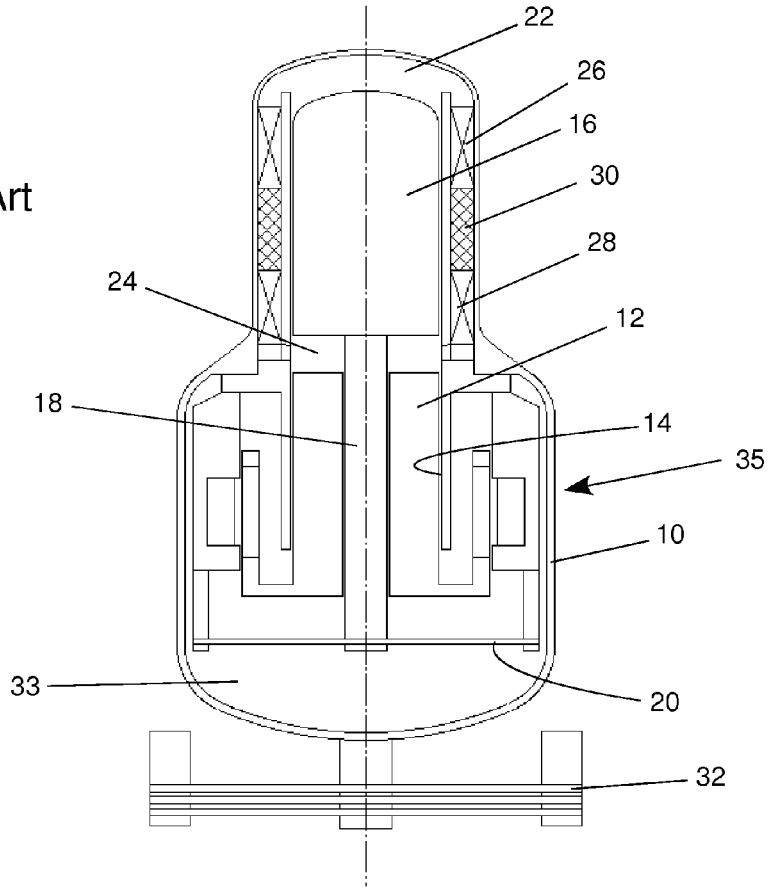
Fig. 1 Prior Art
FIG. 1 is a schematic view in axial section of a prior art beta configuration of a free piston Stirling machine.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose.

DETAILED DESCRIPTION OF THE INVENTION

The invention utilizes the gamma configuration in the free-piston mode with two or more pistons and a single displacer. The pistons are preferably arranged at right angles to the displacer motion. In order to minimize dead volume, the displacer drive area is provided on the displacer spring, which is mounted below the pistons so that the pistons do not have to engage or contact and therefore accommodate the displacer drive rod as in conventional beta machines. This allows the pistons to approach each other to a minimum distance. The displacer and piston motions may be designed to intersect each other for even greater dead volume reduction. The pistons are sized, positioned and reciprocate so as to balance their net forces that are applied to the casing of the machine and cause vibration. This achieves substantial although incomplete balancing. The displacer remains unbalanced but is generally of low mass compared to the overall mass of the machine so that the residual motion is actually quite small and in many cases, acceptable. The displacer amplitude (around 5 to 10 mm) divided by the mass ratio of the overall machine to the displacer (around 20 to 50) gives the residual vibration amplitude. If additional balancing is required, a conventional dynamic balancer could be used but it would be of much smaller mass and size since only the force from the displacer motions would need to be balanced. The pistons are separated assemblies that do not mechanically interact with each other or with the displacer. In fact, the displacer assembly can be made completely separate from the pistons.

Figure 2:
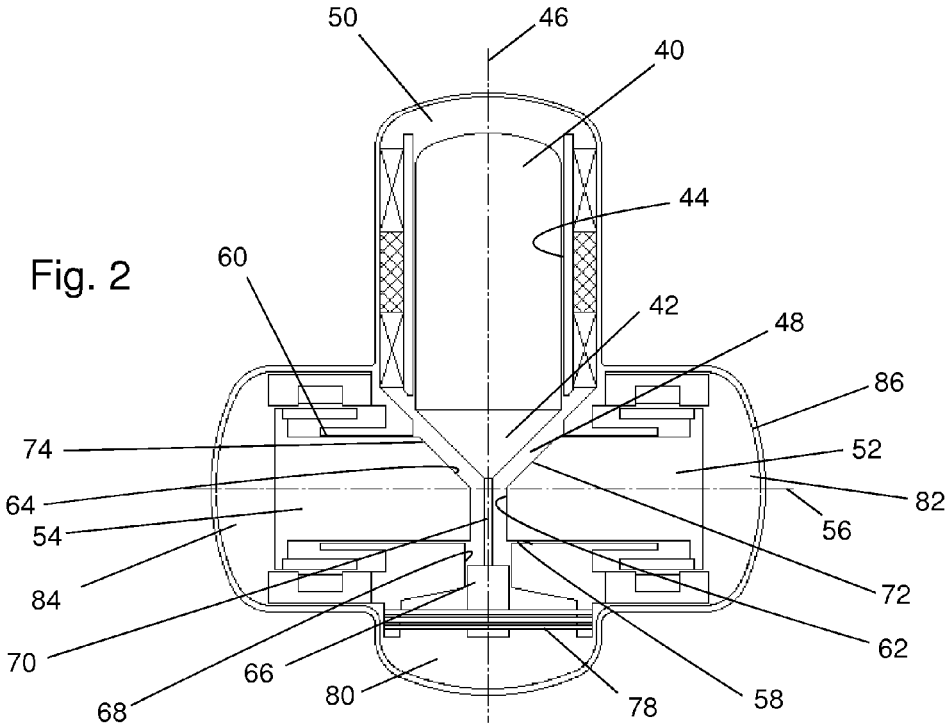
FIG. 2 is a schematic view in axial section of an embodiment of the invention.

FIG. 2 illustrates an improved free piston Stirling machine having a gamma configuration and embodying the invention. The Stirling machine of FIG. 2 has a displacer 40 having an inner end 42. The displacer 40 is reciprocatable within a displacer cylinder 44 along a displacer axis 46. The displacer 40 separates a workspace into a compression space 48 and an expansion space 50.

Two power pistons 52 and 54 are arranged in a balanced configuration for canceling their momentum vectors. In this embodiment, the balanced arrangement is that both pistons 52 and 54 reciprocate along an axis 56 within their respective cylinders 58 and 60. The pistons 52 and 54 reciprocate in opposed relation so that they operate in phase in the sense that both move inwardly and both move outwardly at the same time. In other words during operation they have the same angle of their periodic, approximately sinusoidal, motion with respect to a point between them. Each piston 52 and 54 has an inner end 62, 64. The term "inner" is used to indicate generally the central region of the machine between the pistons and the displacer. The piston cylinders 58 and 60 and the displacer cylinder 44 all have an unobstructed opening at their inner ends into a common volume of the workspace.

Figure 3:
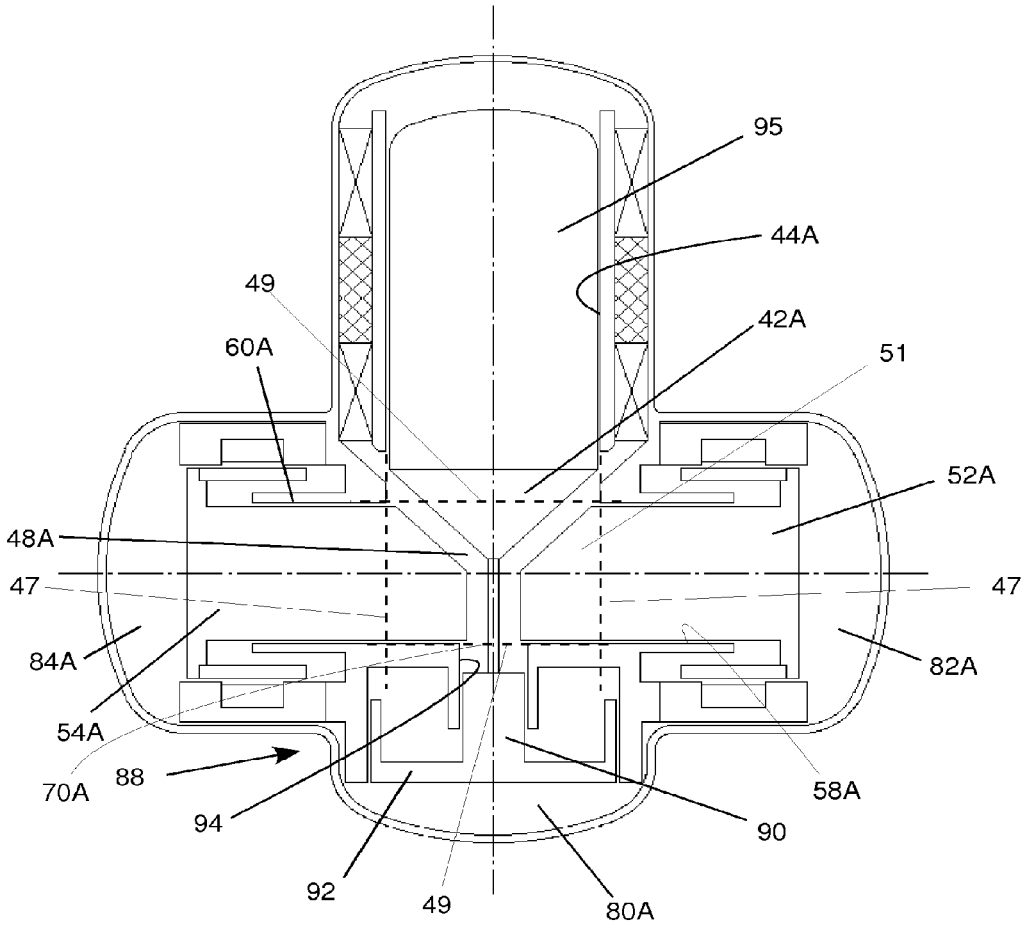
FIG. 3 is a schematic view in axial section of another embodiment of the invention.

The term "common volume" is used to describe a part of the inner volume of the work space. "Common volume" as used in this specification and the claims is the volume within the intersection of inward projections of the displacer cylinder and the piston cylinders as further defined in this paragraph. The inward projection of the displacer cylinder is illustrated in FIG. 3 by the dashed lines 47 and the inward projections of the piston cylinders are shown by the dashed lines 49. If all the cylinders are geometrically projected inwardly, they intersect along curved lines. If these curved lines of intersection are joined together by imaginary surfaces extending between neighboring intersections, the imaginary surfaces surround and define a volume of space 51 that is included within an extension or projection of all the cylinders. That volume of space is the "common volume" and, in the cross sectional view of FIG. 3, appears as a dashed line rectangle. If the displacer or a piston moves sufficiently inwardly and extends partly out of its cylinder, it can enter the common volume. In embodiments of the invention, the displacer and the pistons have a range of reciprocation that extends into the common volume. In the invention, there is no structural object that extends inwardly into a projection of the cylinders between the pistons and the common volume or between the displacer and the common volume. Such a projection would obstruct reciprocation of the displacer or pistons into the common volume. Therefore, in the invention, there is an unobstructed cylindrical path extending from each of the cylinders into the common volume. Although not necessary, preferably the piston and displacer cylinder walls actually join along their lines of intersection but they can not extend beyond the lines of intersection or they would obstruct entry of another piston or the displacer into the common volume.

The terms "dead" volume or space and "unswept" volume or space are also used. In all gamma configured Stirling machines, the inner end of the displacer and the inner end of each piston bound (form a boundary of) a portion of the work space. The displacer and each piston reciprocate in their respective cylinders along a range of reciprocation which varies as a function of working conditions. There is, however, always an inner space or volume that is unswept because it is never entered by the displacer or a piston. That unswept space is referred to as a dead or unswept space or volume. A prior art beta free piston Stirling machine can be configured so there is no dead space because the displacer and piston can move into (occupy) the same cylindrical volume at different times and phases of the cycle. However, in a gamma free piston Stirling machine there is always a dead space and, in prior art machines, it is relatively large. As far as known, because it is necessary to avoid collisions between the pistons or between the displacer and one or more pistons, the range of reciprocation of the pistons and the displacer in prior art gamma machines are maintained far apart and never even come close to the common volume. The invention minimizes the dead space by configuring the components of the gamma free piston Stirling machine so that they are able to enter the common volume and by shaping the reciprocating displacer and pistons so that they can approach each other within the common volume with a minimum of volume between the inner ends of the displacer and pistons. Some small dead volume remains necessary to assure avoidance of collisions.

Returning to a description of the embodiment of FIG. 2, a displacer drive rod 66 is reciprocatable within a drive rod cylinder 68. The displacer drive rod 66 and the displacer drive rod cylinder 68 are positioned outside the common volume and on the opposite side of the common volume from the displacer 40. The displacer 40 is connected to the displacer drive rod 66 by a displacer connecting rod 70.

Although known to those skilled in this art, it is believed desirable to explain the function of the displacer drive rod 66. In a free piston Stirling machine, the gas pressure in the work space varies cyclically and approximately sinusoidally. The gas pressure in the work space is applied to a cross sectional area of the pistons 52 and 54 and the displacer 40 to provide the drive forces that move them. Because the work space gas pressure varies cyclically, the gas pressure variations drive the pistons 52 and 54 and displacer 40 in their cyclic motion, although the displacer 40 is out of phase with the pistons 52 and 54. The drive force on each piston 52 and 54 is easily seen as the cross sectional area of the piston in a plane perpendicular to its axis of motion multiplied by the working space pressure.

In the prior art, a rod of the same diameter along its length extends all the way between the displacer and either a gas spring or a bounce or back space. For example, in the beta configured machine of FIG. 1, the displacer rod 18 extends to the bounce space 33. In known prior art gamma machines, the same is true. The bounce space or a gas spring is not in significant communication with the work space, although there may be very small connections (insignificant for this discussion) for centering. The displacer is driven in reciprocation by the cyclically varying work space pressure acting upon the cross sectional area of the displacer rod in a plane perpendicular to its axis of motion. Consequently, the displacer rod is functioning like a piston. That cross sectional area of the displacer rod may be referred to as the displacer drive area.

In the invention, the displacer 40 is driven in reciprocation in the same manner. However, in the invention, the displacer drive rod 66 and the displacer drive rod cylinder 68 are positioned outside the common volume and on the opposite side of the common volume from the displacer 40. That is done so that the displacer drive rod 66 and the displacer drive rod cylinder 68 are outside the common space and therefore are located where the pistons 52 and 54 can not collide with them. Consequently, the term "displacer drive rod" is adopted to designate the piston upon which working space pressure variations apply the force that drives the displacer in reciprocation. The term "displacer connecting rod" is adopted to designate the mechanical link that connects the displacer drive rod to the displacer. In the invention, the displacer connecting rod 70 can be made to have a small diameter or thickness, considerably smaller than the displacer drive rod 66, and this is done to allow maximum excursion of the pistons into the common volume. The wide diameter rod does not need to extend all the way through the common volume.

Another important feature of the invention is that the displacer 40 and pistons 52 and 54 have complementary interfacing surface contours formed on their inner ends. The term "complementary interfacing surface contours" means that the end surfaces of the pistons and displacer have shapes and locations so that they can approach each other with a small or minimum volume between the interfacing surfaces. In this manner, these reciprocating components can move significantly far into the common volume so that most of the common volume is no longer a dead or unswept space.

Referring again to FIG. 2, the inner end 42 of the displacer 40 is a cone in the preferred embodiment. In order to minimize the distance that the displacer 40 can approach the pistons 52 and 54, where the inner end of the displacer 40 has a conical contour, the complementary interfacing surface contours on the pistons are segments 72 and 74 of a cone.

The inner end 42 of the displacer 40 is shaped conically in order to intersect the motion of the pistons 52 and 54, which are themselves shaped to accept the displacer motions without collision. The degree of intersection is a designer's choice. Zero intersection results in maximum unswept volume while maximum intersection results in minimum unswept volume. The displacer drive rod 66 is placed beyond the reach of the pistons 52 and 54.

Figure 7:
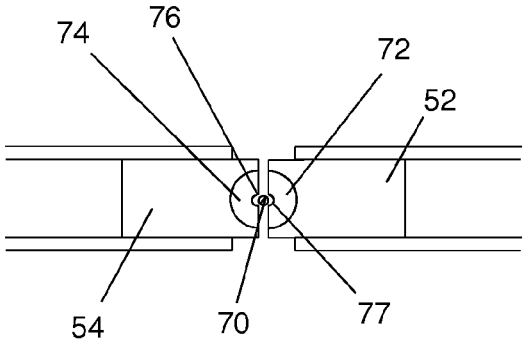
FIG. 7 is a diagrammatic view in horizontal section illustrating the complementary interfacing surface contours on the pistons of the embodiment illustrated in FIGS. 2 and 6A.

Referring to FIG. 7, the pistons may also be recessed in order to avoid collision with the displacer connecting rod 70. The pistons 52 and 54 can each have a little groove (e.g. a semi-cylindrical cut out) 76, 77, in addition to the conical surfaces 72 and 74, to avoid collisions with the connecting rod 70. Of course the groove or cut out 76, 77 can have other shapes. So, in embodiments of the invention it is preferred that the inner end of each piston have a cavity with a surface contour that is complementary in size and position to the displacer connecting rod. These cavities or cut outs allow the pistons to approach each other to a minimum distance. Minimum means small, which is an engineering design choice, but they still must avoid collision with displacer rod. Of course the displacer connecting rod could alternatively have the same diameter as the displacer drive rod with a cavity or cylindrical cut out in the pistons having the required larger diameter.

As known in the art, the displacer's cyclical motion leads the pistons' cyclical motion. So, not only are the displacer and pistons shaped to avoid collisions, the pistons can occupy some of the same space/volume as the displacer at different times, as in the beta machine because the displacer is moving outwardly when the pistons are still moving inwardly. The degree that each piston and the displacer travel into the common volume is a designers engineering choice. The closer the machine is designed to have them approach each other and approach the connecting rod the more reduction in dead volume but the greater the risk that operation could go outside of the designed range of reciprocation and result in a collision.

Returning to FIG. 2, the bounce spaces 80, 82 and 84 are connected together as known in the art, for example by pipes or passageways within the casing 86. As known in the art, the pressure in the bounce spaces 80, 82 and 84 has a nearly constant pressure. However, as discussed below, if a gas spring is used, the gas spring's gas chamber is not connected to the bounce space.

Mechanical planar springs 78 are attached to the displacer drive rod 66. The displacer 40 and pistons 52 and 54 travel in a cylinder assembly that may simply be one piece with intersecting axes for the displacer and piston cylinders 44, 58 and 60. The pistons 52 and 54 may be connected to linear alternators, gas compressors and/or other mechanical loads or to motors which drive the pistons 52 and 54 depending on whether the machine is an engine or a cooler (heat pump).

Synchronicity of the piston motions is achieved by a common workspace, a common bounce space and a common alternator/motor connection.

The inner ends of the pistons 52 and 54 and the displacer 40 can alternatively have other complementary interfacing surface contours. For example, they could have stair-stepped contours. As another alternative, the displacer 40 could be a simple cylindrical shape with, for example a planar end perpendicular to its axis, and each piston 52 and 54 could have a complementary semi-cylindrical cut-out aligned along a radial of the cylindrical piston. If there are more than two pistons, as subsequently discussed, the pistons can also have relief (cut outs) for the other pistons as well as cavities or cut outs that are complementary with the displacer connecting rod. Migrating rotation of the pistons 52 and 54 during operation that would cause a misalignment of the complementary interfacing surface contours is prevented by a planar spring 78 or a linear alternator.

FIG. 3 illustrates an opposed piston gamma configured machine which is like the embodiment of FIG. 2 except that it has a gas spring 88 to provide the springing action for the displacer instead of a planar spring. The displacer drive rod 90 is connected to a gas spring piston 92 which slides in a gas spring cylinder 94 to form a conventional gas spring. This configuration allows the displacer drive rod 90, the cross-sectional area of which defines the displacer drive area, and the gas spring piston 92 to be compactly formed as an integral body. Both the displacer drive rod 90 and the gas spring piston 92 are positioned outside the common volume 51 and on the opposite side of the common volume 51 from the displacer 95. In some cases, it may be advantageous to use a gas spring. The gas sprung machine retains tuning independent of pressure and therefore tolerates pressure changes due to ambient temperatures, for example, with greater ease than a mechanically sprung displacer would. Since the gas spring adjusts its spring rate directly according to pressure, and further, since the pistons' net spring rates also adjusts directly according to pressure, such a machine will retain tuning with changes in charge pressure. This is especially useful for machines that are subjected to wide ambient temperature variations, for example, as might be required of a solar converter in desert conditions. Not shown, but typically included with gas sprung components, is a mechanical spring, such as a planar spring, to provide a centering force so that the component does not drift off center due to gravity or differential leakage across the gas spring piston 92.

Figure 4:
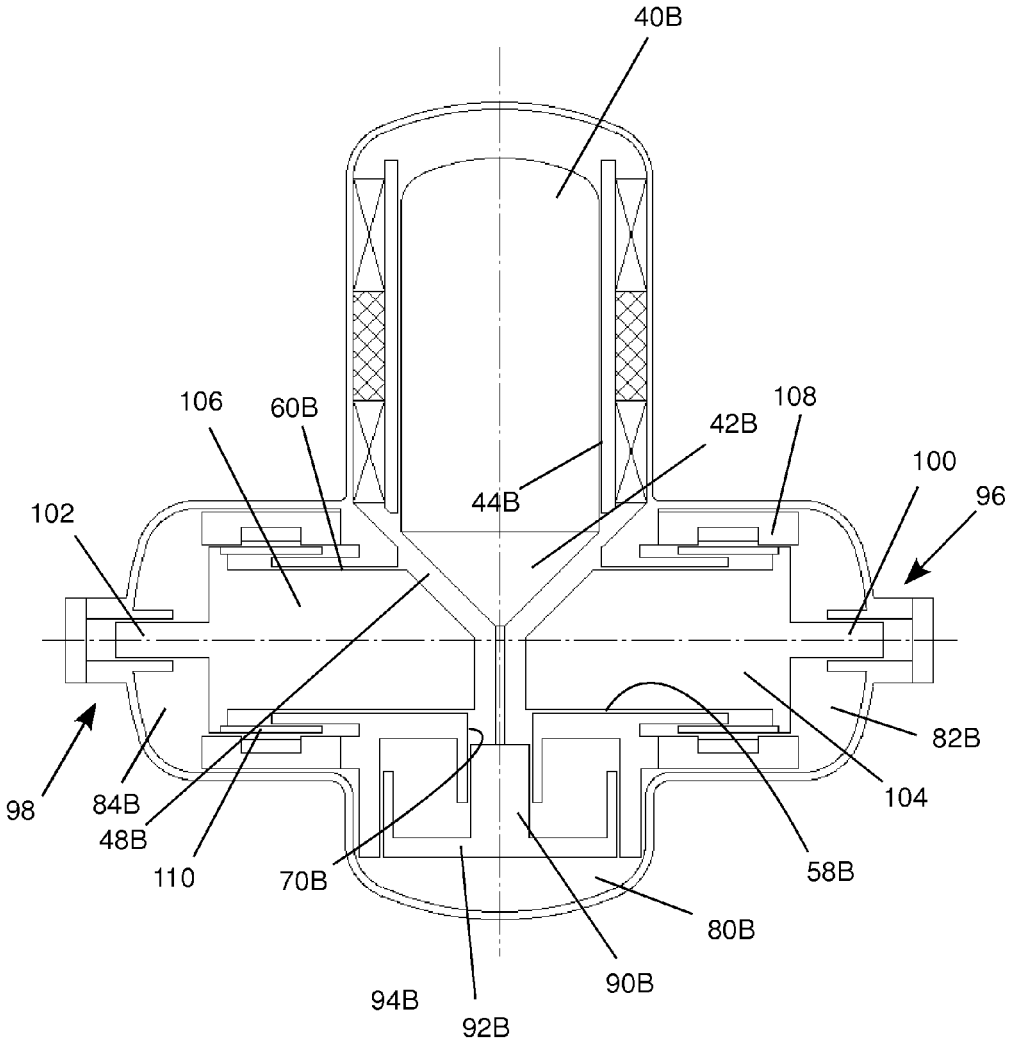
FIG. 4 is a schematic view in axial section of still another embodiment of the invention.

FIG. 4 shows a version of the gamma opposed piston machine with a gas sprung displacer like that illustrated in FIG. 3. The machine is driving opposed linear compressors 96 and 98 that have their compressor pistons 100 and 102 directly attached to the Stirling machine pistons 104 and 106 as would be useful for heat pumping applications as described in U.S. Pat. No. 6,701,721, which is herein incorporated by reference. Like the machine of FIG. 3, the machine of FIG. 4 is also driving linear alternators as may be used in conjunction with U.S. Pat. No. 6,701,721 for application to heat pumping. In this case, since the mean pressure changes with the operating condition of the heat pump, it is essential to employ a gas sprung displacer in order to maintain tuning. The machine in FIG. 4 also has other parts like the machines in FIGS. 2 and 3. It has a displacer 40B that reciprocates in cylinder 44B and has a conical end 42B. Its pistons 104 and 106 reciprocate in cylinders 58B and 60B and like the displacer 40B enter a common volume 48B. It has a bounce space 80B, 82B and 84B. It also has a displacer drive rod 90B fixed to a gas spring piston 92B that reciprocated in a cylinder 94B. The gas spring piston 92B is attached to the displacer 40B by a connecting rod 70B.

FIG. 5 shows how a gamma opposed piston machine embodying the invention can be assembled. The displacer and piston assemblies are completely separate and may be aligned independently. The displacer is aligned separately within its own cylinder to form a displacer sub-assembly 120 that is placed into the casing 124. The piston sub-assemblies 126 and 128 are similarly aligned and attached to the casing 124. Each of these subassemblies requires no precision alignment with respect to any other. The hot section assembly (if an engine, otherwise the cold section, if a cooler) 122 is the final closure for the machine. An attachment flange 130 for a burner (if an engine) or for a dewar (if a cooler) is also shown. The single expansion space provides simple access to the hot (or cold) end of the machine.

As illustrated in FIG. 6, a gamma free piston Stirling machine embodying the invention may be configured with more than the two opposed pistons as illustrated in FIGS. 2, 3 and 4. Any number of pistons greater than two may be used, provided they can be practically accommodated, and arranged in a manner that their momentum vectors sum to zero and therefore balance out or cancel their vibration components. The illustrations in FIG. 6 show the casing exteriors for representative arrangements of two, three, and four pistons.

FIG. 6A shows the arrangement of a two-piston embodiment as illustrated in FIGS. 2, 3 and 4. The displacer casing portion 140 is oriented at a right angle to the axis of reciprocation of the pistons in the opposed piston casing portions 142. In order for machines of two or more pistons to have identical power, pressure and frequency, the total cross sectional area provided by the pistons for each configuration should be identical. So a three-piston machine of identical power, pressure and frequency would have individual pistons of ⅔ the area of the two-piston machine and the four-piston machine would have individual piston areas of half of the two-piston machine.

Figure 8:
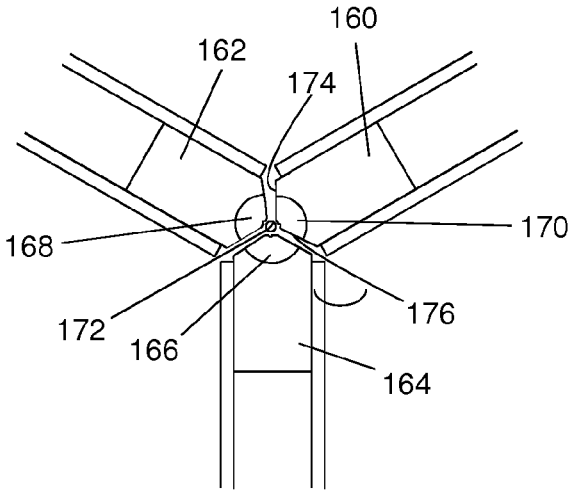
FIG. 8 is a diagrammatic view in horizontal section illustrating the complementary interfacing surface contours on the pistons of the embodiment illustrated in FIG. 6B.

FIG. 6B illustrates the arrangement of three pistons within casing portions 148, 150 and 152. The pistons reciprocate along axes that are coplanar and equi-angularly spaced around the reciprocation axis of the displacer casing portion 146. As shown in FIG. 8, the three pistons 160, 162 and 164 may be provided with complementary interfacing surface contours that have conical contoured surfaces 166, 168 and 170 that are complementary with a displacer having a conical surface at its inner end. Similarly, the three pistons 160, 162 and 164 may also be provided with cut outs that are complementary with a displacer connecting rod. Additionally, in order for the three pistons 160, 162 and 164 to be able to closely approach each other in the central common volume, the ends of the pistons may also have end surfaces, such as planar end surfaces 174 and 176, at an angle, such as 60°, to their axes of reciprocation, so that the opposite end surfaces of each piston are at 120° of each other. Of course other complementary interfacing surface contours can be used.

Figure 9:
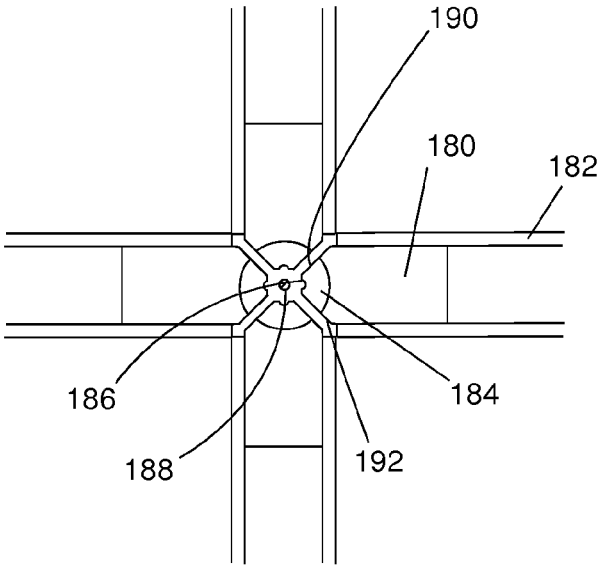
FIG. 9 is a diagrammatic view in horizontal section illustrating the complementary interfacing surface contours on the pistons of the embodiment illustrated in FIG. 6C.

FIG. 6C shows an arrangement with four pistons reciprocating along coplanar axes spaced at 90 degree angles with each axis making a 90 degree intersection with the reciprocation axis of the displacer. The same concept of providing complementary interfacing surface contours on the pistons and on the displacer is illustrated for the four piston arrangement in FIG. 9. Although there are four pistons and their four cylinders, they are identical so only one is described. A piston 180 reciprocating in its cylinder 182 has a complementary interfacing surface contour 184 that is a segment of a cone for accommodating a displacer having a conical inner end. It also has a semi-cylindrical cut out or channel 186 to form an interfacing surface contour that is complementary to the displacer connecting rod 188. Additionally, the end of the piston 180 has planar end surfaces 190 and 192 at 90° to each other to allow all four of the pistons to closely approach each other without collision.

There are other balanced arrangements for three or more pistons. Any number of pistons can be arranged with axes of reciprocation that are equi-angularly spaced including a three dimensional arrangement. Additionally, pistons can be arranged to reciprocate along axes with still other relative orientations. Pistons having different masses may also be used with the only requirement for balancing the vibrations being that their momentum vectors sum to zero.

Even without any vibration balancer, the only residual vibration of a machine embodying the invention is the vibration resulting from the momentum of the displacer and the consequent reaction momentum of the casing. Therefore, it is desirable to reduce the mass of the displacer as much as practical because the displacer is the only component causing vibration. Because amplitude of the casing vibration is proportional to the mass of the displacer multiplied by the amplitude of the displacer divided by the total mass of the remainder of the machine multiplied by the amplitude of the casing, vibration amplitude is proportional to the ratio of the displacer mass to the mass of the remainder of the machine. Therefore, there an incentive to make the mass of the displacer as small as possible, relative to the entire mass of the machine.

From the above, it can be seen that, although a typical prior art gamma configured free piston Stirling machine has a large and therefore undesirable dead volume, embodiments of the invention greatly reduce and nearly eliminate the dead volume while retaining the other benefits of the gamma configuration. This reduction in the dead volume gives a higher capacity per unit of machine volume (i.e. the size of the entire machine). The reduction improves the specific capacity of the machine where specific capacity is defined as the work or power per unit of volume of the machine, whether operated as an engine or a cooler/heat pump.

A visual comparison of the drawings of FIGS. 1 and 2 allows a comparison of a conventional beta configured free piston Stirling machine compared in size with a two-piston machine configured according to the current invention where the two are designed for identical power, frequency and pressure. Minimization of the unswept displacer and piston cylinder volumes is achieved by shaping the displacer and pistons so that their motions may intersect without physical collisions. Clearly, the opposed piston gamma machine of FIG. 2 is shorter and more compact than the beta configured machine of FIG. 1. In a design exercise, a 1 Kw opposed piston gamma machine was found to be 20 kg less mass than an equivalent conventional beta machine of the same pressure and frequency. Vibration levels of the opposed piston gamma without any vibration balancer were similar to the beta machine with a vibration balancer attached to it.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. An improved free piston Stirling machine having a gamma configuration and including a displacer having an inner end and reciprocatable within a displacer cylinder along a displacer axis and separating a workspace into a compression space and an expansion space, the improvement comprising:

(a) at least two power pistons, the pistons arranged in a balanced configuration for canceling their momentum vectors, each piston having an inner end and being reciprocatable within a piston cylinder having an inner end, each piston cylinder having an unobstructed opening at the respective inner end into a common volume of the workspace, the common volume being defined by intersection of inward projections extending from each of the displacer cylinder and the piston cylinders, such that the displacer and the pistons each have a range of reciprocation extending into the common volume; and (b) a displacer drive rod reciprocatable in a drive rod cylinder, the displacer drive rod and the drive rod cylinder positioned outside the common volume and on the opposite side of the common volume from the displacer, the displacer being connected to the displacer drive rod by a displacer connecting rod.

2. A free piston Stirling machine in accordance with claim 1 wherein the displacer and pistons have complementary interfacing surface contours formed on the respective inner end of each of the displacer and the pistons.

3. A free piston Stirling machine in accordance with claim 2 wherein the displacer connecting rod has a smaller thickness than the displacer drive rod.

4. A free piston Stirling machine in accordance with claim 2 wherein the inner end of each piston has a cavity with a surface contour that is complementary in size and configured to accept the displacer connecting rod.

5. A free piston Stirling machine in accordance with claim 2 wherein the inner end of the displacer has a conical contour and the complementary interfacing surface contours on the pistons are segments of a conical surface.

6. A free piston Stirling machine in accordance with claim 2 wherein there are at least three of said pistons.

7. A free piston Stirling machine in accordance with claim 2 wherein there are at least four of said pistons.

8. A free piston Stirling machine in accordance with claim 2 wherein the displacer is sprung to at least one of a mechanical spring and a gas spring for displacer resonance.

9. A free piston Stirling machine in accordance with claim 2 wherein the pistons are connected to at least one of a linear motor, a linear alternator, and a linear compressor.

10. A free piston Stirling machine in accordance with claim 2 wherein the displacer connecting rod has a smaller thickness than the displacer drive rod and the inner end of each piston has a cavity with a surface contour that is complementary in size and position to the displacer connecting rod.

11. A free piston Stirling machine in accordance with claim 10 wherein the inner end of the displacer has a conical contour and the complementary interfacing surface contours on the pistons are segments of a conical surface.

12. A free piston Stirling machine in accordance with claim 11 wherein there are at least three of said pistons.

13. A free piston Stirling machine in accordance with claim 12 wherein there are at least four of said pistons.

* * * * *